United States Patent [19]

Smith et al.

[11] Patent Number: 4,611,463

[45] Date of Patent: Sep. 16, 1986

[54] OPEN-END SPINNING MACHINE

[75] Inventors: Alan Smith, Accrington; Stephen W. Yates, Greater Manchester, both of England

[73] Assignee: Hollingsworth (U.K.) Ltd., Accrington, England

[21] Appl. No.: 743,441

[22] Filed: Jun. 11, 1985

[30] Foreign Application Priority Data

Jun. 13, 1984 [GB] United Kingdom ..... 8415001

[51] Int. Cl.[4] ..... D01H 15/00; D01H 11/00; D01H 9/10

[52] U.S. Cl. ..... 57/263; 57/266; 57/268

[58] Field of Search ..... 57/261, 263, 266, 268, 57/271, 300–302; 242/35.5 A

[56] References Cited

U.S. PATENT DOCUMENTS 3,432,877 3/1969 Black, Jr. et al. .
3,950,926 4/1976 Stahlecker ..... 57/263
4,059,946 11/1977 Stahlecker .
4,138,839 2/1979 Stahlecker .
4,159,620 7/1979 LaFlaquiere et al. ..... 57/263 X
4,178,748 12/1979 Stahlecker et al. ..... 57/268 X
4,275,554 6/1981 Tarbon et al. .
4,418,525 12/1983 Raasch ..... 57/268 X
4,539,803 9/1985 Ferro et al. ..... 57/268 X

FOREIGN PATENT DOCUMENTS 2460375 6/1976 Fed. Rep. of Germany .
2355932 1/1978 France .

*Primary Examiner*—Donald Watkins
*Attorney, Agent, or Firm*—Cort Flint

[57] ABSTRACT

An open-end spinning machine incorporating a doffer robot also includes separate tracks for the doffer robot and a piecer-cleaner robot. The robots are able to patrol continuously along one side of the machine and back along the other side of the machine, with sufficient separation for the doffer robot to pass the piecer-cleaner robot, and vice versa and for the two robots to pass end casings of the machine.

10 Claims, 2 Drawing Figures

OPEN-END SPINNING MACHINE

FIELD OF THE INVENTION

The present invention relates to a doffer robot for an open-end spinning machine, and also provides a multi-position open-end spinning machine incorporating both a doffer robot and a piecer-cleaner robot.

PRIOR ART

It has been known to provide for automated doffing and piecing in open-end spinning machines by use of a doffer robot which patrols the two sides of the machine and, upon receipt of a "package full" signal, will stop at a particular spinning station, remove the full package, and replace that with a tube which may be either cylindrical or conical, to serve as the core on which the next package is to be wound. A separate piecer-cleaner robot will then arrive at the same spinning station once it has been vacated by the doffer robot and will clean the open-end spinning chamber and then insert a "seeding" end of yarn into the spinning chamber and, when spinning resumes, the seeding end becomes a part of the package being delivered. The piecer-cleaner robot also services a spinning station at which a yarn break may have occurred in which case there will be no need for the doffer to attend to that station first, because the package will not yet have become fully wound.

Because of the need for the piecer to operate in the vicinity of the spinning chamber of each spinning station, it has a cantilever portion projecting forwardly into the vicinity of each spinning chamber and, as a result, is unable to pass the head end of the machine, and possibly also unable to pass the foot end.

Also, because of the more frequent need for attention by the piecer-cleaner which services not only the spinning stations with full packages but possibly also any with yarn breaks part-way through the winding process, it is known in such a case for the doffer to give way to the piecer and, because the doffer is in the conventional system able to patrol round both ends of the machine, it will travel the long way round the machine when it needs to service a station just the other side of the piecer-cleaner robot. In this prior system, for example the type 777 robot marketed by Platt Saco Lowell Corporation, the doffer robot and the piecer-cleaner robot patrol on the same track, outside the machine.

OBJECT OF THE INVENTION

It is an object of the invention to provide an open-end spinning machine having both a doffer robot and a piecer-cleaner robot, in which the piecer-cleaner robot does not obstruct the movement of the doffer robot.

It is a further object of the invention to provide an open-end spinner in which the doffer robot is able to patrol the various spinning stations in a predetermined regular sequence.

SUMMARY OF THE INVENTION

According to the present invention we provide an open-end spinning machine having a double-sided elongate frame with a plurality of spinning stations arranged along each of the sides of that frame; a first track; a piecer-cleaner robot able to patrol along the first track to face the spinning stations along the two opposed sides of the machine in succession in a repeating sequence; a second track separate from the first track; the configurations of the doffer and piecer-cleaner robots and the first and second tracks on which they run being such that the doffer robot can pass the piecer robot while the piecer robot is servicing any of the spinning stations on either side of the double sided open-end spinning machine. Thus the doffer robot and the piecer-cleaner robot are both able to patrol along the two opposed sides of the machine in succession in a repeating sequence.

BRIEF DESCRIPTION OF THE DRAWINGS

In order that the present invention may more readily be understood the following description is given, merely by way of example, with reference to the accompanying drawings in which.

DESCRIPTION OF THE PREFERRED EMBODIMENTS

Figure 1:
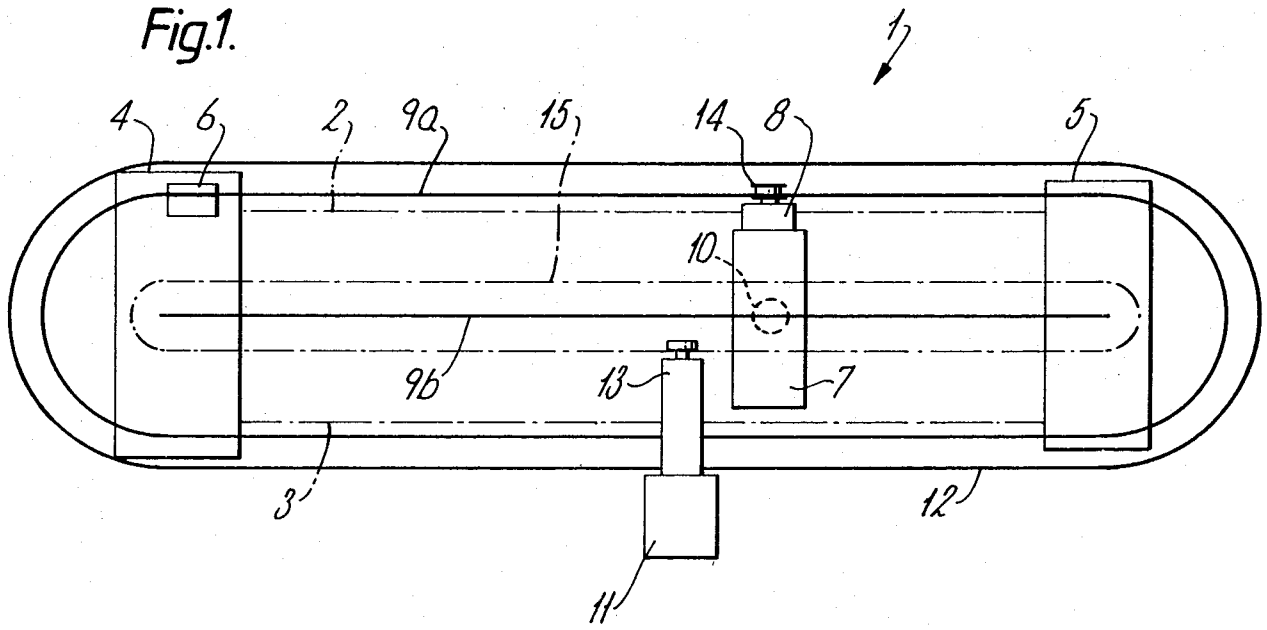
FIG. 1 is a top plan view of a double-sided open-end spinning machine in accordance with the present invention.

Referring now to FIG. 1, there will be seen a double-sided open-end spinning machine 1 having two banks of spinning stations, one along a first side 2 of the elongate machine frame and the other along a second side 3 of that frame.

At the head end of the frame is the customary gearing end casing 5, and a shorter but otherwise externally similar casing 4 is positioned at the foot or off end to the machine.

At the off end 4 is a vertical stack 6 for delivering a plurality of empty winding tubes to a doffer robot 7 which travels along the centre of the machine frame. In practice the stack 6 will have a horizontally directed upper end which allows the cones delivered from the top end of the stack to be directed onto an outwardly projecting receiving end of the doffer robot 8.

As can be seen from FIG. 1, the doffer robot 7 patrols along a continuous track **9*a* running along the length of the frame of the open-end spinning machine 1 between the two opposite sides 2 and 3 of the frame, and is steadied by a central pivot 10 on a central rectilinear track 9*b* to allow the doffer robot 7 to service the spinning stations along the two opposite sides 2 and 3 of the frame. The doffer robot 7 has wheels 14 (FIG. 2) running on the track 9*a*. Clearly, the doffer robot 7 can pass the spinning stations towards the off end 4 along the side 2 of the machine frame and then towards the head end 5 along side 3 as it continues on its journey along track 9*a*. In this way there is a given repeating sequence of patrolling the various spinning stations which may be as many as 72 along each of the sides 2 and 3** making a total of 144.

Figure 2:
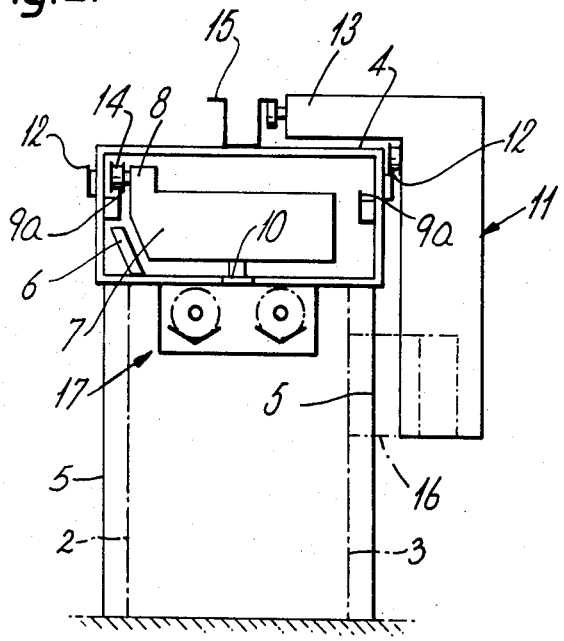
FIG. 2 is an end elevation of the machine of FIG. 1 showing the piecer-cleaner robot and the doffer robot.

Meanwhile, a piecer-cleaner robot 11 patrols externally of the machine 1 on an outer oval track 12 which runs right around the ends of the machine 1. The piecer-cleaner robot 11 has a cantilevered upper portion 13 which projects inwardly and above the spinning stations along the two sides of the frame to co-operate with a central track 15 (FIG. 2).

The piecer-cleaner robot 11 also has a cantilevered lower portion 16 which is mounted for translational movement between a fully extended position in which it can engage the machine frame to steady the robot 11 and service the associated spinning station even to the point of sweeping clean the spinning chamber an introducing seeding yarn into that chamber for resumption of spinning, and a second position in which it is fully retracted to allow the piecer-cleaner robot 11 to resume patrolling and even to pass both the off end and head end casings 4 and 5, respectively, of the machine. Again, the piecer-cleaner robot 11 patrols continuously unidirectionally around the machine 1.

By virtue of the completely independent tracks 9 and 12 the doffer robot 7 and the piecer-cleaner robot 11, respectively, can service the various spinning stations of the open-end spinning machine 1 completely independently of one another in the optimum sequence because there is no problem of conflicting paths of the doffer robot and the piecer-cleaner robot.

Because the stack delivery mechanism 6 for winding tubes delivers to the doffer robot 7 a considerable number of, in this case six, empty tubes to be offered to the spinning stations in place of doffed packages, there is no need for the doffer robot to return to the off end 4 to receive further empty tubes from the conveyor 6 until all six of its tubes have been pre-wound and then inserted. In practice, a sensor will be provided to detect when the doffer robot only carried two tubes, and at that stage the doffer robot will stop at the off end 4 when it next passes it during its unidirectional patrolling, in order to receive further tubes.

During this patrolling, the doffer robot 7 is unobstructed by the piecer cleaner robot 11.

FIG. 2 shows that the piecer-cleaner robot is additionally supported by the central track 15 above the path of the doffer robot 7.

Also, FIG. 2 shows the feed stack 6 of empty winding tubes to be given to the doffer robot 6, and it also shows the conveyor 17 to transport full doffed packages away to one end of the machine for delivering to a store or to further processing.

We claim:

1. An open-end spinning machine comprising:

(a) double-sided elongate frame means having opposed first and second sides;

(b) a plurality of spinning stations arranged along each of said first and second sides of that frame means, each said spinning station including a spinning chamber;

(c) first track means;

(d) a piecer-cleaner robot able to patrol along the first track means, to face the spinning stations along said opposed first and second sides thereof in succession in a repeating sequence;

(e) second track means separate from the first track means;

(f) a doffer robot which is able to patrol along said second track means thereby orbiting said elongate frame means, and is able to face said spinning stations on said first and second opposed sides of the frame means in succession in a repeating sequence during said orbiting, (g) winding tube supply means positioned at one given location along said second track means and adapted to supply said doffer robot with yarn winding tubes to be subsequently applied individually to respectively ones of said spinning stations when said respective spinning stations are being serviced by said doffer robot;

wherein the configurations of the first and second track means and those of the doffer and piecer-cleaner robots are such that the doffer robot can pass the piecer robot while the piecer robot is servicing any one of the spinning stations on both of said first and second sides of the frame means.

2. An open-end spinning machine according to claim 1, wherein said second track means is mounted on top of the machine frame, and the doffer robot patrolling on said second track means sweeps a given volume; and wherein the first track means supports the piecer-cleaner robot outside said given volume swept by the patrolling doffer robot.

3. An open-end spinning machine comprising:

(a) double-sided elongate frame means having opposed first and second sides;

(b) a plurality of spinning stations arranged along each of said first and second sides of that frame means, each said spinning station including a spinning chamber;

(c) first track means;

(d) a piecer-cleaner robot able to patrol along the first track means, to face the spinning stations along said opposed first and second sides thereof in succession in a repeating sequence;

(e) second track means separate from the first track means; and (f) a doffer robot able to patrol along said second track means so as to be able to face said spinning stations on said first and second opposed sides of the frame means in succession in a repeating sequence;

wherein the configurations of the first and second track means and those of the doffer and piecer-cleaner robots are such that the doffer robot can pass the piecer robot while the piecer robot is servicing any one of the spinning stations on both of said first and second sides of the frame means; wherein said second track means is mounted on top of the machine frame, and the doffer robot patrolling on said second track means sweeps a given volume; and wherein the first track means support the piecer-cleaner robot outside said given volume swept by the patrolling doffer robot.

4. An open-end spinning machine according to claim 3, wherein the second track means comprises an oval outer track rail, and a rectilinear central track rail supporting a pivot on which the doffer robot is rotatable about a vertical axis to allow it to service the spinning stations on each of said first and second sides of the frame means.

5. An open-end spinning machine according to claim 4, wherein the first track means includes an outer oval track rail, and an inner track rail above said rectilinear track rail of the first track means.

6. An open-end spinning machine comprising:

(a) double-sided elongate frame means having opposed first and second sides;

(b) end casings to said frame means at opposite ends thereof, at which ends the frame means is wider than at other points along its length;

(c) a plurality of spinning stations arranged along each of said first and second sides of that frame means, each said spinning station including a spinning chamber;

(d) first track means;

(e) a piecer-cleaner robot able to patrol along the first track means, to face the spinning stations along said opposed first and second sides thereof in succession in a repeating sequence;

(f) second track means separate from the first track means;

(g) a doffer robot able to patrol along said second track means so as to be able to face said spinning stations on said first and second opposed sides of the frame means in succession in a repeating sequence, (h) a retractable cantilevered portion to said piecer-cleaner robot;

(i) spinning chamber cleaning means carried by said retractable cantilevered portion for cleaning the open-end spinning chambers of said spinning stations of the machine;

(j) piecer means carried by said retractable cantilevered portion for introducing a seeding yarn end into each said spinning chamber; and (k) means operable to retract said retractable portion sufficiently far to allow the piecer-cleaner robot to clear said end casings at both of said opposite ends of the frame means; wherein the configurations of the first and second track means and those of the doffer and piecer-cleaner robots are such that the doffer robot can pass the piecer robot while the piecer robot is servicing any one of the spinning stations on both of said first and second sides of the frame means.

7. An open-end spinning machine according to claim 6, and including means at one of said ends of the open-end spinning machine frame means for supplying empty yarn winding tubes to the doffer robot.

8. An open-end spinning machine according to claim 6, wherein said second track means is mounted on top of the machine frame, and the doffer robot patrolling on said first track means sweeps a given volume; and wherein the first track means supports the piecer-cleaner robot outside said given volume swept by the patrolling doffer robot.

9. An open-end spinning machine according to claim 8, wherein the second track means comprises an oval outer track rail, and a rectilinear central track rail supporting a pivot on which the doffer robot is rotatable about a vertical axis to allow it to service the spinning stations on each of said first and second sides of the frame means.

10. An open-end spinning machine according to claim 7, wherein the first track means includes an outer oval track rail, and an inner track rail above said rectilinear track rail of the first track means.

* * * * *